United States Patent [19]

Breitung et al.

[11] 4,239,947

[45] Dec. 16, 1980

[54] CRUISE CONTROL SWITCH ASSEMBLY

[75] Inventors: Edward J. Breitung, Springfield; Ronald J. Hickman, Rochester, both of Ill.

[73] Assignee: Stewart-Warner Corporation, Chicago, Ill.

[21] Appl. No.: 959,410

[22] Filed: Nov. 9, 1978

[51] Int. Cl.[3] ..... H01H 3/14

[52] U.S. Cl. ..... 200/61.89; 29/622; 200/153 C; 200/153 LA; 200/303

[58] Field of Search ..... 200/61.89, 61.76, 61.87, 200/61.88, 153 LA, 159 A, 159 R, 303, 153 C; 29/622

[56] References Cited

U.S. PATENT DOCUMENTS

| | | | |
|---|---|---|---|
| 2,006,690 | 7/1935 | Blake | 200/61.89 X |
| 3,211,847 | 10/1965 | Johnson | 200/153 LA |
| 3,751,618 | 8/1973 | Hallerberg | 200/159 R |

*Primary Examiner*—J. V. Truhe
*Assistant Examiner*—Morris Ginsburg
*Attorney, Agent, or Firm*—Augustus G. Douvas; Dillis V. Allen

[57] ABSTRACT

A switch assembly having a single plunger that sequentially actuates electrically independent terminal contacts such as found in a speed control and brake light switch adapted to be actuated by an automobile brake assembly. The switch has a reciprocable plunger with a conductive ferrule on its end that actuates one set of terminal contacts and an intermediate cylindrical cam that operates another set of terminal contacts. A cover is positioned over an opening in the housing and it has a first integral yolk projection that surrounds a reduced shank on the plunger to maintain the plunger within the housing which permits the plunger to be inserted from outside the housing during assembly, and it also has an integral slotted projection that fits over one set of terminals to secure these terminals within the housing.

16 Claims, 6 Drawing Figures

CRUISE CONTROL SWITCH ASSEMBLY

BACKGROUND OF THE INVENTION

It has been conventional over the past half decade prior to the filing of this application to provide a single switch assembly mounted beneath the dashboard of a vehicle which is actuated by an arm in the brake assembly to control both the automatic speed control system of the vehicle, commonly referred to as "cruise control" and also the vehicle brake lights. The switch is mounted so that when the brake pedal is not depressed by the operator, the brake arm will depress a central plunger in the switch in some fashion to maintain the vehicle cruise control system on and the brake lights off. Generally these speed control systems known in the art today deactivate upon depression of the brake pedal by the operator so that the vehicle may be decelerated without the interference of the speed control system. Further, it is of course desired that the brake lights go "on" when the brake pedal is depressed. Both of these functions have been incorporated into a single plunger operated switch assembly.

In prior plunger operated switch assemblies designed for this purpose, many parts have been required to make up the terminals and contacts for the speed control function and also the brake light control function and because of this the assembly of prior switch arrangements of this type have been costly. A second problem is that the plunger assemblies of these prior switches have either required internal insertion, i.e., insertion from within the switch housing, or they have required separate elements to retain the plunger assemblies within the housing. The result of both of these alternatives is not only additional parts, but also additional manipulations to assemble the plunger assembly and maintain it in its proper position within the housing.

It is a primary object of the present invention to ameliorate the problems of prior art dual contact plunger operated switch assemblies of the type described above.

SUMMARY OF THE PRESENT INVENTION

In accordance with the present invention a plunger operated switch assembly is provided that sequentially actuates two electrically independent sets of contacts which requires far fewer number of parts than in prior switch assemblies of this type and also is capable of much simpler assembly with fewer manipulative steps. The present plunger operated switch is particularly adapted for the application described above wherein it is actuatable directly by the brake assembly of a vehicle to substantially simultaneously interrupt the automatic speed control system of the vehicle and actuate the rear brake lights when the operator depresses the brake pedal.

The speed control contacts are spaced apart one-piece terminal and contact members axially positioned in one end of a housing parallel to the plunger and are actuated by an electrically conducting ferrule mounted on the end of the plunger and slideable between the speed control contacts. A spring normally urges the plunger outwardly from the switch housing so that the speed control terminals are normally "open". The brake light terminals are snapped within the housing and extend generally at an axis perpendicular to the axis of movement of the plunger. Brake light contacts, attached to the terminals, are normally closed and their terminals flank an intermediate portion of the plunger.

The plunger has an integral enlarged cylindrical cam that upon inward movement of the plunger engages and separates the brake light terminals and the associated brake light contacts which has the circuit effect of turning "off" the brake lights.

Functionally the present switch is intended of course to actuate the brake lights and terminate the speed control when the plunger is moved outwardly and to maintain the speed control operative and deactuate the brake lights when the plunger is moved inwardly by the brake assembly when not depressed by the operator.

Another important aspect of the present invention is that the cover for the housing maintains several of the parts of the switch in position without the need for any additional elements. The cover has an integral downward yoke projection that engages a shoulder on the plunger to maintain the plunger in position in the housing against the biasing force of a coil spring acting on the plunger. During assembly, the plunger is inserted within the housing against the biasing force of the spring and when the cover is thereafter positioned on the housing, this yoke engages the shoulder on the plunger when it is released preventing movement of the plunger from the housing by the spring. Still a second function is provided by the cover in that it has slotted projections which fit over the speed control terminals to secure them in their proper position within the housing.

The yoke and slotted projections on the cover permit the present switch to be assembled in a far simpler manner than was previously thought possible. With the brake light terminals and contacts snapped within the housing, the speed control terminals are initially positioned in partial slots in the housing—but this does not rigidly secure these terminals in their proper position. A coil spring is then placed around the plunger and the plunger is inserted into the housing from the outside of an annular plunger boss. With the plunger held in this position the cover is then attached to the housing with the integral yoke flanking a reduced section on the plunger preventing its removal and simultaneously the slotted projections flank the speed control terminal contacts to rigidly secure them in position. This is a far simpler assembly than would be required if additional parts were necessary to secure the plunger or either sets of terminals within the housing.

DETAILED DESCRIPTION OF THE PREFERRED EMBODIMENT

Figure 1:
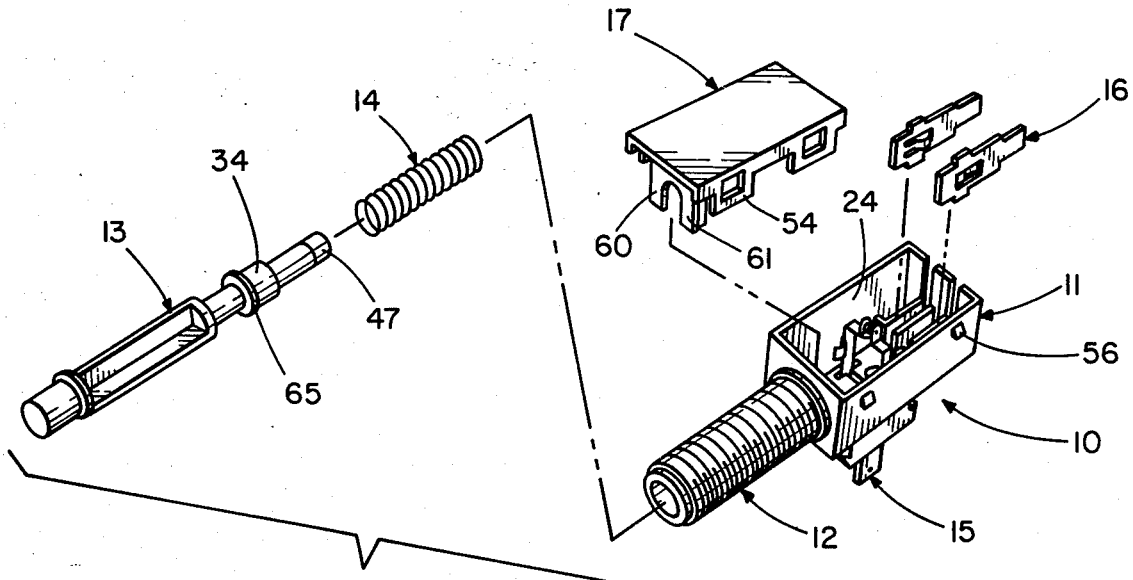
FIG. 1 is an exploded view of the present plunger operated switch assembly.
Figure 2:
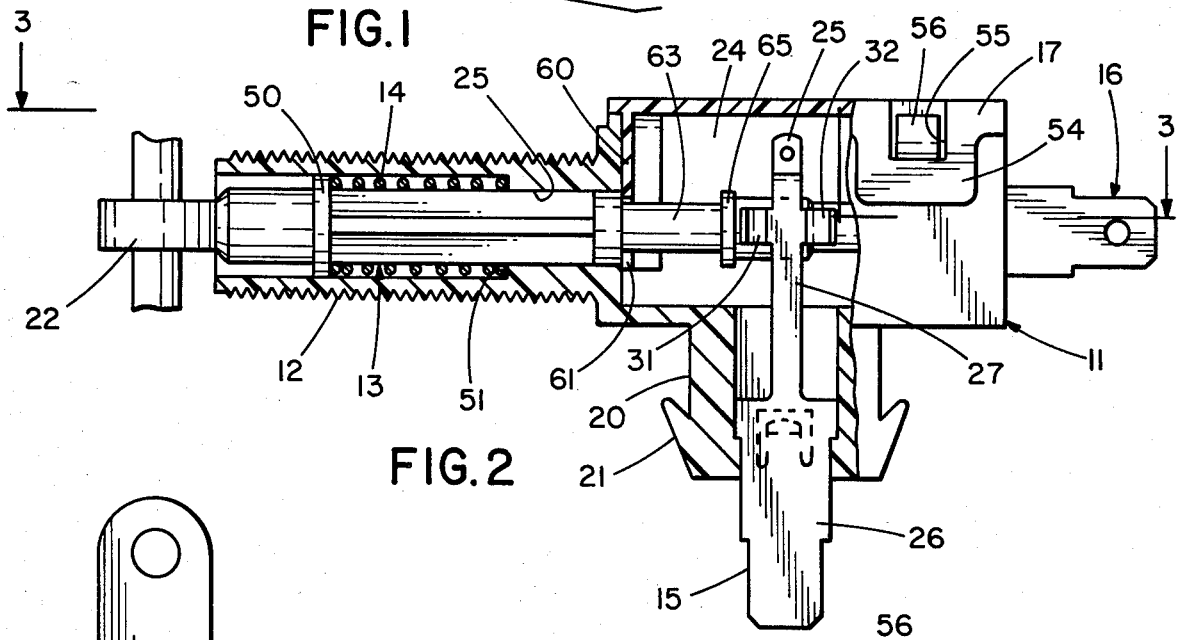
FIG. 2 is a fragmentary top view of the present plunger operated switch assembly.

Referring to the drawings, and particular FIG. 1, the present plunger operated switch assembly is generally designated by the reference numeral 10. It is seen to include a generally rectangular housing 11 having an integral threaded plunger boss 12, a plunger operator 13 biased by coil compression spring 14, a pair of generally perpendicularly disposed brake light terminals and contacts 15, a pair of spaced speed control terminals and contacts 16, and a releasable cover 17 that serves to retain the plunger 13 in position and also to secure the speed control terminals and contacts 16 within the housing 11.

The housing 11 is a one-piece plastic molding having a rectangular laterally extending projection 20 with a pair of rearwardly extending barbs 21 that together form a connector for the brake light terminals 15.

Figure 5:
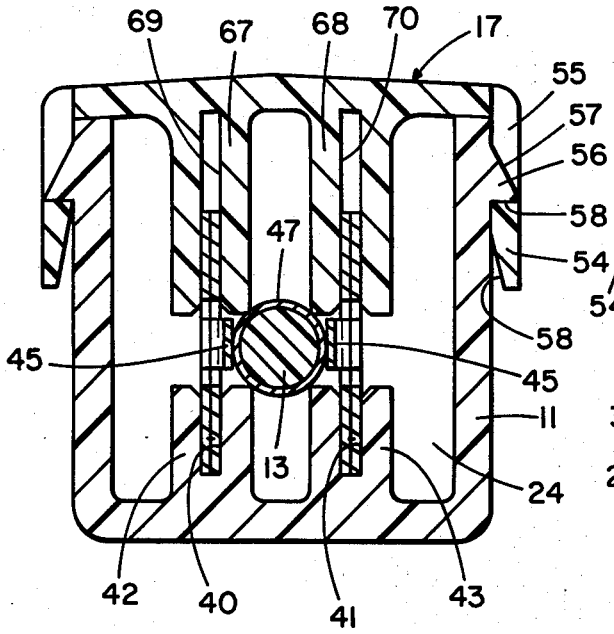
FIG. 5 is a cross-section taken generally along line 5—5 of FIG. 3.
Figure 6:
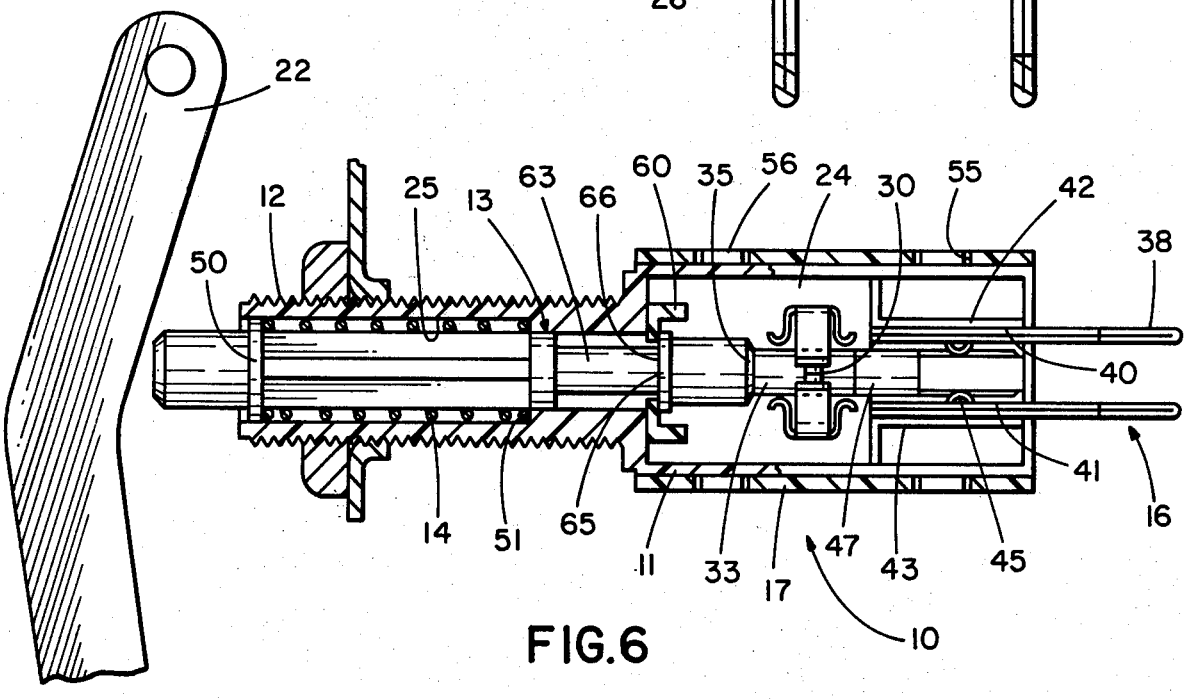
FIG. 6 is a side view of the present plunger operated switch assembly shown in its operative position with a brake assembly when the brake is being depressed by the operator's foot.

The threaded plunger boss 12 permits the entire switch assembly 10 to be threaded into a stationary bracket adjacent the rear side of a brake assembly shown diagrammatically at 22 in FIGS. 5 and 6. The switch is positioned so that plunger 13 is depressed when the brake assembly 22 is in its released position (as in FIG. 6), i.e., not engaged by the operator's foot. Housing 11 has a generally rectangular central opening 24 therein which communicates with a plunger bore 25 extending axially through the plunger boss 12.

Figure 4:
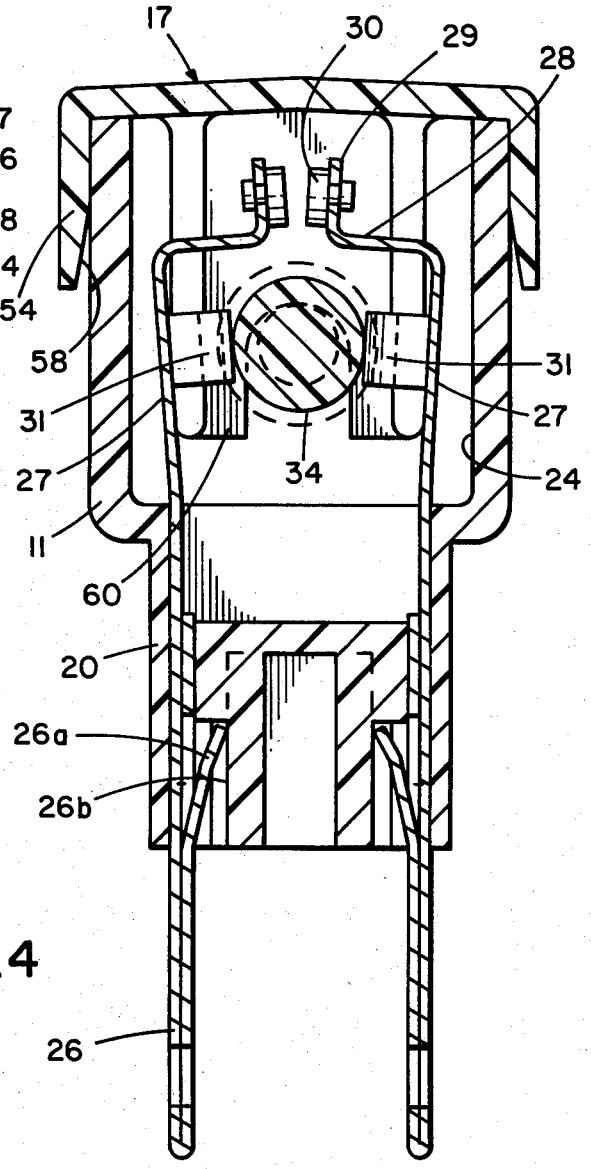
FIG. 4 is a cross-section taken generally along line 4—4 of FIG. 3.

The brake light terminals and contacts 15 have terminal ends 26 projecting from the housing portion 20 and flexible contact ends 27 extending within the central housing opening 24. The terminals are secured within the housing by tabs that snap into recesses **26*b* within housing 11 as shown clearly in FIG. 4. Each of the contact terminals 15 has a laterally extending contact leg portion 28 connected with a vertically extending contact leg portion 29 that carries a contact element 30. The vertical leg portions 27 are positioned such that the contact elements 30 are normally "closed" when not engaged by the plunger 13. Each of the contact support legs 27 has curved flanges 31 and 32 that flank plunger portion 33 when the plunger 13 is biased to its outward position by spring 14**.

Figure 3:
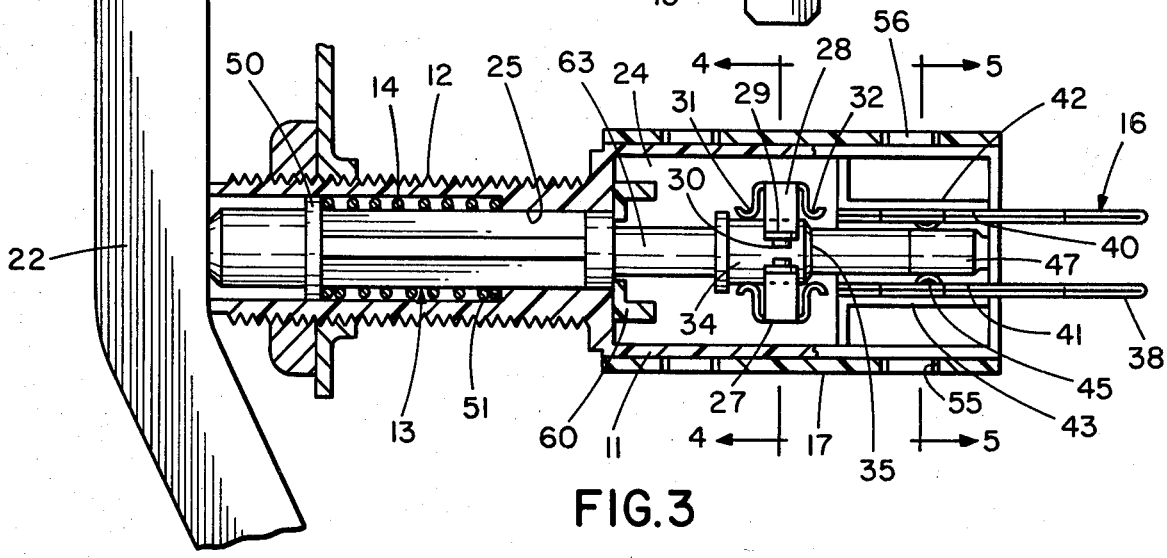
FIG. 3 is a side view, partly in section, of the present plunger operated switch assembly shown in its operative position with the brake assembly urging the switch plunger inwardly.

When the plunger is moved inwardly from its outermost assembled position, shown in FIG. 6, to its innermost position, shown in FIG. 3, an enlarged cylindrical cam 34 having a frustoconical cam surface 35 engages the flanges 31 and 32 of the brake light terminal contacts 15 separating the contacts 30.

The speed control contact terminals 16 have terminal ends 38 projecting from housing 11. The terminal contacts 16 are spaced apart and partly received in slots 40 and 41 in projections 42 and 43 extending upwardly from the bottom of central opening 24 in the housing 11, as shown best in FIG. 5. The projections 42 and 43 retain the terminal contacts 16 in position during assembly prior to the final positioning of the cover 17. The terminal contacts 16 have integral contact fingers 45 that are normally spaced apart within the housing opening 24 so that the speed control switch is considered a "normally open" switch, i.e., with the plunger 13 biased to its outermost position by the coil spring 14.

The end of the plunger 13 has a conductive metallic cylindrical cup-shaped ferrule 47 that fits between the speed control contact terminals 16 and simultaneously engages both of the contact fingers 45 to provide a conductive path between the terminals closing the speed control switch when the plunger 13 is in its depressed or inwardmost position, as seen in FIGS. 3 and 5.

The plunger 13 is continuously biased outwardly from the housing 11 by coil spring 14 which reacts against an enlarged shoulder 50 near the outward distal end of the plunger 13. The other end of spring 14 reacts against a shoulder 51 within the bore 25 in the housing 11. Plunger 13 is slideably supported in the bore 25.

The cover 17 in addition to covering the housing opening 24 also serves the additional two functions of (a) retaining the plunger 13 within the housing 11 and also (b) securing the speed control terminals 16 within the housing 11. The cover 17 has four downwardly projecting flexible tabs 54 that have rectangular openings 55 therein which receive barbed projections 56 appropriately aligned therewith on the sides of the housing 11. The projections 56 have camming surfaces 57 (see FIG. 5) which engage camming surfaces 58 on the internal sides of the tabs 54 bending the tabs 54 outwardly somewhat as the cover 17 is placed over the opening 54 until the projections 56 clear the openings 55 at which time the tabs 54 will snap completely over the projections 56 with projection shoulders 58 maintaining the cover in position. The cover 17 may be removed by bending the tabs 54 outwardly until the openings 55 clear the projections 56.

The cover 17 has a downward projection 60 having a U-shaped opening 61 therein that fits over a reduced diameter portion 63 on the plunger 13. A flange 65 is provided on the plunger 13 having a diameter greater than the width of the U-shaped opening 61 in the cover projection 60 so that projection will engage shoulder 66 limiting the outward movement of the plunger 13 within the housing 11, as seen in FIG. 6.

The cover 17 also has downward projections 67 and 68 having slots 69 and 70 (see FIG. 5) that receive the speed control terminals 16 to secure them within the housing 11 as the cover 17 is positioned on the housing during assembly.

During assembly, with the brake control contacts 15 already positioned within housing 11, the speed control contacts 16 are placed in housing slots 40 and 41. Thereafter the coil spring 14 is placed over the plunger 13 with the spring in engagement with plunger flange 50. The plunger 13 and spring 14 are then inserted within the plunger boss 12 inwardly toward the housing opening 24. With the plunger 13 fully depressed, the cover 17 is inserted over the housing opening 24. The plunger is held in that position (shown in FIG. 3) until the projection 60 is slid over the reduced diameter portion 63 of the plunger and thereafter the plunger may be released, and it moves to the position shown in FIG. 6 with cover projection 60 engaging plunger flange 65 preventing further outward movement of the plunger. During the same time the cover slots 69 and 70 are positioned over the speed control contacts 16 to hold them firmly in position.

As shown in FIG. 3, the switch 10 in its position where the brake assembly 22 biases the plunger 13 to its inwardmost position against the outwardly biasing force of spring 14. The speed control contact fingers 45 are closed by the conductive path provided by the plunger ferrule 47. This maintains the associated speed control system in operation if it has been so set by an independent control (not shown). At the same time the brake contacts 30 are maintained in spaced apart non-conducting position by the engagement of cam 34 with curved flanges 31 and 32.

When the brake assembly 22 is depressed as shown in FIG. 6, the plunger 13 will move outwardly under the biasing force of spring 14 until flange 65 hits the cover projection 60 which limits further outward movement of the plunger 13. In this position the plunger conducting ferrule 47 separates from the speced contacts 45 opening these contacts which, by appropriate circuitry not shown, serves to terminate operation of the speed control system in a fashion well known to those skilled in this art. Shortly after the ferrule separates from contacts 45 the plunger cam 34 moves away from the brake light terminal projections 31 and 32 permitting the contact legs 27 to move together closing contacts 30 which energizes appropriate conventional circuitry to turn the brake lights of the vehicle "on".

What is claimed is:

1. A switch having a single actuator for opening and closing two sets of contacts, comprising; a housing, a first set of contacts in the housing, a second independent set of contacts in the housing, a plunger reciprocable in the housing and having an end extending from the housing adapted to be engaged by an external element to actuate both sets of contacts, and a spring biasing the plunger outwardly from the housing, said plunger having a conductive portion fixed thereto in such manner as to prohibit relative movement with respect to said plunger and so dimensioned that it is selectively slideably engageable between and against the first set of contacts in the housing to close the contacts, said plunger having a non-conductive cam portion engageable with the second contacts for actuating the second set of contacts whereby movement of the plunger from the external element causes actuation of the first and second sets of contacts.

2. A switch having a single actuator for opening and closing two sets of contacts as defined in claim 1, wherein said plunger has a conductive ferrule at the distal end thereof extending within the housing for actuating the first set of contacts.

3. A switch having a single actuator for opening and closing two sets of contacts as defined in claim 2, wherein said first set of contacts includes parallel spaced members on said housing having spaced contact elements, said ferrule being movable between and in engagement with said contact elements for defining a conductive path therebetween whereby said first set of contacts are selectively opened when the plunger is moved outwardly from the housing by the spring.

4. A switch having a single actuator for opening and closing two sets of contacts as defined in claim 1, wherein said second set of contacts includes two spaced terminals positioned in the housing generally perpendicular to the axis of the plunger.

5. A switch having a single actuator for opening and closing two sets of contacts as defined in claim 4, wherein said terminals each have contact elements engageable with one another when the spring moves the plunger outwardly from the housing, said cam portion being an integral cylindrical portion on the plunger movable between the spaced terminals to force them apart and separate the contact elements to interrupt the current flow therebetween.

6. A switch for controlling the speed control and brake lights of a vehicle that is positioned to be actuated by the brake pedal assembly, comprising; a housing, a plunger slideable in the housing having an end projecting from the housing adapted to be actuated and moved axially by the brake pedal assembly, a coil spring around said plunger biasing the plunger outwardly from the housing, a first set of speed contacts in said housing normally in a spaced apart position, a second independent set of brake light contacts in the housing positioned generally perpendicular to the axis of the plunger, said second set of contacts being closed in the normal position when the spring moves the plunger outwardly from the housing, said plunger having an annular electric conducting ferrule on the distal end thereof that is movable between the first set of contacts for closing the first set of contacts, and said plunger having an intermediate integral non-conducting cylindrical cam movable between said second set of contacts for opening said second set of contacts whereby when said plunger is moved inwardly within the housing by the brake pedal assembly the plunger will close the first set of contacts and open the second set of contacts, and when the brake pedal assembly releases the plunger permitting the spring to move the plunger outwardly from the housing the plunger will open the first set of contacts and close the second set of contacts.

7. A switch for controlling the speed control and brake lights of a vehicle that is positioned to be actuated by the brake pedal assembly, comprising; a housing, a plunger slideable in the housing having an end projecting from the housing adapted to be actuated and moved axially by the brake pedal assembly, a coil spring around said plunger biasing the plunger outwardly from the housing, a first set of speed contacts in said housing normally in a spaced apart position, a second independent set of brake light contacts in the housing positioned on an axis generally perpendicular to the axis of the plunger, said second set of contacts being closed in the normal position when the spring moves the plunger outwardly from the housing, said plunger having an annular electric conducting ferrule on the distal end thereof that is movable between said first set of contacts for closing the first set of contacts, said plunger having an intermediate integral cylindrical cam movable between said second set of contacts for opening said second set of contacts, and said second set of contacts having terminals spaced apart and snapped in the housing whereby when said plunger is moved inwardly within the housing by the brake assembly the plunger will close the first set of contacts and open the second set of contacts, and when the brake assembly releases the plunger permitting the spring to move the plunger outwardly from the housing the plunger will open the first set of contacts and close the second set of contacts.

8. A switch having a single actuator for opening and closing two sets of contacts, comprising; a housing, a first set of contacts in the housing, a second set of contacts in the housing, a plunger reciprocable in the housing and having an end extending from the housing adapted to be engaged by an external element to actuate the switch and both sets of contacts, a spring in the housing biasing the plunger outwardly from the housing, said plunger having a conductive portion fixed thereto that is selectively engageable with the first set of contacts in the housing to close the contacts, said plunger having a non-conductive cam portion engageable with the second contacts for actuating the second set of contacts, whereby movement of the plunger from the external element causes substantially simultaneous actuation of the first and second set of contacts, said housing having a generally rectangular opening therein permitting assembly of the conacts within the housing, and a cover for the housing having an integral projection for limiting movement of the plunger in at least one direction of axial movement.

9. A switch having a single actuator for opening and closing two sets of contacts, comprising; a housing, a first set of contacts in the housing, a second set of contacts in the housing, a plunger reciprocable in the housing and having an end extending from the housing adapted to be engaged by an external element to actuate the switch and both sets of contacts simultaneously, a spring in the housing biasing the plunger outwardly from the housing, said plunger having a conductive portion fixed thereto that is selectively engageable with the first set of contacts in the housing to close the contacts, said plunger having a non-conductive cam portion engageable with the second contacts for actuating the second set of contacts whereby movement of the plunger from the external element causes substantially simultaneous actuation of the first and second set of contacts, an opening in said housing permitting the assembly of the contacts therein, slot means in said housing for releasably but not completely holding the first set of contacts in the housing, a cover for said opening in the housing releasably secured to the housing, and having integral slotted projections in the housing for receiving parts of the first set of contacts in position so that during assembly the first set of contacts may be initially positioned within the housing and thereafter the cover secured to the housing with the integral projections on the cover engaging the first set of contacts.

10. A switch assembly for actuating two electrically independent sets of contacts, comprising; a housing, a first set of contacts in the housing, a second set of contacts in the housing spaced from the first set of contacts, a plunger reciprocable in the housing and having an end projecting from the housing adapted to be actuated by an external element, a spring in said housing biasing said plunger outwardly from the housing, said plunger having a maximum outer diameter such that it may be inserted externally into the housing, said plunger having a first portion engageable to actuate said first set of contacts and a second portion engageable to actuate said second set of contacts substantially simultaneously upon movement of the plunger, a shoulder on said plunger normally positioned within the housing, said housing having an opening therein permitting assembly of the switch, and a cover for said opening releasably secured to the housing, said cover having an integral projection which extends within the housing to engage the shoulder on the plunger and maintain the plunger within the housing after positioning the cover in the housing during assembly.

11. A switch assembly for actuating two electrically independent sets of contacts as defined in claim 10, including slotted projections on said housing for receiving the first set of contacts and partly holding the contacts during assembly of the switch, and integral slotted projections formed on said cover receiving the first set of contacts to complete the support for the first set of contacts within the housing.

12. A switch assembly for actuating two electrically independent sets of contacts, comprising; a housing, a first set of contacts in the housing, a second set of contacts in the housing spaced from the first set of contacts, a plunger reciprocable in the housing and having an end projecting from the housing adapted to be actuated by an external element, a spring in said housing biasing said plunger outwardly from the housing, said plunger having a maximum outer diameter such that it may be inserted into the housing, said plunger having a first portion engageable to actuate said first set of contacts and a second portion engageable to actuate said second set of contacts substantially simultaneously upon movement of the plunger, a shoulder on said plunger normally positioned within the housing, said housing having an opening therein permitting assembly of the switch, a cover for said opening releasably secured to the housing, slotted projections in said housing for partly supporting said first set of contacts, and said cover having integral slotted projection means for receiving the first set of contacts and completing the support for the first set of contacts within the housing.

13. A method of assembling a switch having spaced sets of independent contacts within a housing actuable by a plunger slideable within the housing from an external actuating element, the steps including; forming a housing having a central opening therein and a plunger opening communicating therewith, positioning first and second sets of contacts in said central opening to be actuated by the plunger, forming a plunger with a shoulder to be positioned within the central opening, forming a cover for the opening having a projection that will extend within the central opening, inserting the plunger in the plunger opening through its external end, and thereafter positioning said cover over the central opening so that the cover projection engages the shoulder on the plunger to maintain the plunger within the housing.

14. A method of assembling a switch having spaced sets of independent contacts within a housing actuable by a plunger slideable within the housing from an external actuating element as defined in claim 13, wherein the steps of forming the cover include the step of forming a slotted projection on the cover extendable within the housing opening, and said step of positioning the cover over said housing opening including the step of positioning the slotted cover projection over the first contacts to secure the first contacts within the housing.

15. A method of assembling a switch having spaced sets of independent contacts within a housing actuable by a plunger slideable within the housing from an external actuating element, the steps including; forming a housing having a central opening therein and a plunger opening communicating therewith, positioning first and second sets of contacts in said central opening to be actuated by the plunger, forming a plunger with a shoulder to be positioned within the central opening, forming a cover for the opening having a first projection that will extend within the central opening and having a second slotted projection, surrounding the plunger with a coil spring, thereafter inserting the plunger and spring into the plunger opening in the housing from outside the housing, and thereafter positioning the cover over the central opening so that the first projection engages the plunger shoulder to maintain the plunger in position within the housing and so that the slotted projection engages the first set of contacts to secure them in the housing.

16. A switch having a single actuator for opening and closing two sets of contacts, comprising; a housing, a first set of contacts in the housing, a second independent set of contacts in the housing, a plunger reciprocable in the housing and having an end extending from the housing adapted to be engaged by an external element to actuate both sets of contacts, and a spring biasing the plunger outwardly from the housing, said plunger having a portion fixed thereto that is selectively engageable against the first set of contacts in the housing to close said first set of contacts, said second set of contacts being normally closed and supported by spring support elements that flank the plunger, said plunger having a non-conductive cam portion engageable with the second set of contacts' support elements for separating the elements and opening said second set of contacts, whereby movement of the plunger from the external element causes actuation of the first and second sets of contacts.

* * * * *